United States Patent [19]

Kobata et al.

[11] Patent Number: 4,889,785

[45] Date of Patent: Dec. 26, 1989

[54] ELECTROPHOTOGRAPHIC LIGHT-SENSITIVE MATERIAL

[75] Inventors: Tomokazu Kobata; Yosuke Matsui, both of Kobe, Japan

[73] Assignee: Bando Chemical Industries, Ltd., Kobe, Japan

[21] Appl. No.: 282,668

[22] Filed: Dec. 12, 1988

[30] Foreign Application Priority Data

Dec. 10, 1987 [JP] Japan ..... 62-313805
Oct. 7, 1988 [JP] Japan ..... 63-254225

[51] Int. Cl.[4] ..... G03G 5/14
[52] U.S. Cl. ..... 430/59
[58] Field of Search ..... 430/59

[56] References Cited

U.S. PATENT DOCUMENTS 4,321,318 3/1982 Anderson et al. ..... 430/59
4,403,025 9/1983 Horie et al. ..... 430/59
4,410,615 10/1983 Goto et al. ..... 430/59
4,594,304 6/1986 Watarai et al. ..... 430/59

FOREIGN PATENT DOCUMENTS 60-218652 11/1985 Japan ..... 430/59

*Primary Examiner*—Roland E. Martin
*Attorney, Agent, or Firm*—Wegner & Bretschneider

[57] ABSTRACT

In an electrophotographic light-sensitive material having a layer of a charge transporting substance and a layer of a charge producing substance on an electrically conductive support, the charge transporting substance is an arylaldehydehydrazone derivative of the general formula:

where $R^1$, $R^2$ and $R^3$ are each an alkyl or aryl group.

2 Claims, 18 Drawing Sheets

ELECTROPHOTOGRAPHIC LIGHT-SENSITIVE MATERIAL

BACKGROUND OF THE INVENTION

1. Field of the Invention

This invention relates to an electrophotographic light-sensitive material. More particularly, it is an electrophotographic light-sensitive material having a composite light-sensitive layer formed by a layer of a charge transporting substance and a layer of a charge producing substance on an electrically conductive support.

2. Description of the Prior Art

Various types of light-sensitive materials have been developed and are used in different electrophotographic reproduction processes. All of them, however, have their own drawbacks. For example, a light-sensitive material having a layer of selenium is low in flexibility and its handling involves quite a bit of difficulty, as selenium is a highly toxic substance. A light-sensitive material having a layer of zinc oxide can only poorly be charged with electricity, shows a high degree of charge attenuation in the dark, and is low in sensitivity. There is also known a light-sensitive material having an organic light-sensitive layer formed by a charge transfer complex composed of polyvinylcarbazole and trinitrofluorenone. This material is also low in sensitivity and the toxicity of trinitrofluorenone presents a difficult problem, too.

A composite or laminated type electrophotographic light-sensitive material has been developed to improve the prior materials as hereinabove described. This type of light-sensitive material is disclosed in, for example, Japanese Patent Publications Nos. 42380/1980 and 34099/1985. It comprises an electrically conductive support 3 having a layer of aluminum 2 deposited on a polyester film 1, a layer 4 of a charge producing substance formed on the aluminum layer 2, and a layer 5 of a charge transporting substance formed on the layer 4, as shown by way of example in FIG. 18.

Examples of the charge transporting substance include p-N,N-dialkylaminobenzaldehyde-N',N'-diphenylhydrazone, particularly p-N,N-diethylaminobenzaldehyde-N',N'-diphenylhydrazone, p-N,N-diphenylaminobenzaldehyde-N'-methyl-N'-phenylhydrazone and p-N-ethyl-N-phenyl-aminobenzaldehyde-N'-methyl-N'phenylhydrazone. The layer of any such substance and the layer of a charge producing substance are laid on the electrically conductive support. The layer of a charge transporting substance is formed by, for example, dissolving it in an organic solvent to prepare a solution containing a binding resin, which may further contain a plasticizer, etc. as required, applying the solution onto the support or the layer of a charge producing substance, and drying it, whereby a layer having a thickness of, say, 5 to 100 microns is formed.

The charge transporting substance has a decisive bearing on the performance or quality of any electrophotographic light-sensitive material of the type to which this invention pertains. The manufacture of an electrophotographic light-sensitive material having high sensitivity requires the provision of a layer containing a charge transporting substance in a relatively high concentration and therefore the use of a charge transporting substance which is highly compatible with the resin used as a bonding agent. The substance must also be one from which any such layer can be formed easily. Moreover, the charge transporting substance is required to have an appropriately low oxidation potential and a high charge transfer rate, so that the charge which is produced in the layer of the charge producing substance may be effectively injected into the layer of the charge transporting substance. However, organic compounds having a low oxidation potential are generally liable to oxidation and unstable.

None of the known hydrazone derivatives as hereinabove mentioned is always satisfactory in view of the required physical properties which have hereinabove been stated. The use of any such hydrazone derivative still fails to provide any electrophotographic light-sensitive material of high sensitivity. None of any such known compounds is satisfactory in stability, either.

SUMMARY OF THE INVENTION

Under these circumstances, it is an object of this invention to provide an electrophotographic lightsensitive material of the composite or laminated type including a layer of a charge transporting substance which is highly compatible with a bonding agent, has an appropriately low oxidation potential, is stable and has a high charge transfer rate, and having a high degree of sensitivity.

As a result of our extensive research efforts, we, the inventors of this invention, have discovered a novel arylaldehydehydrazone derivative which satisfies all of the requirements for an improved charge transporting substance as hereinabove stated.

The object of this invention is, therefore, attained by an electrophotographic light-sensitive material having a layer of a charge transporting substance and a layer of a charge producing substance formed on an electrically conductive support, characterized in that the charge transporting substance is an arylaldehydehydrazone derivative of the general formula:

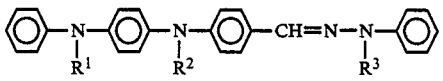

where $R^1$, $R^2$ and $R^3$ are each an alkyl or aryl group.

The arylaldehydehydrazone derivative is highly compatible with an organic solvent and a resin used as a bonding agent, has an appropriately low oxidation potential, exhibits a completely reversible oxidation-reduction reaction and is, therefore, very stable, and also has a high charge transfer rate. The electrophotographic lightsensitive material of this invention containing any such derivative as a charge transporting substance has, therefore, a high degree of sensitivity and a high degree of printing resistance.

DETAILED DESCRIPTION OF THE INVENTION

Figure 1:
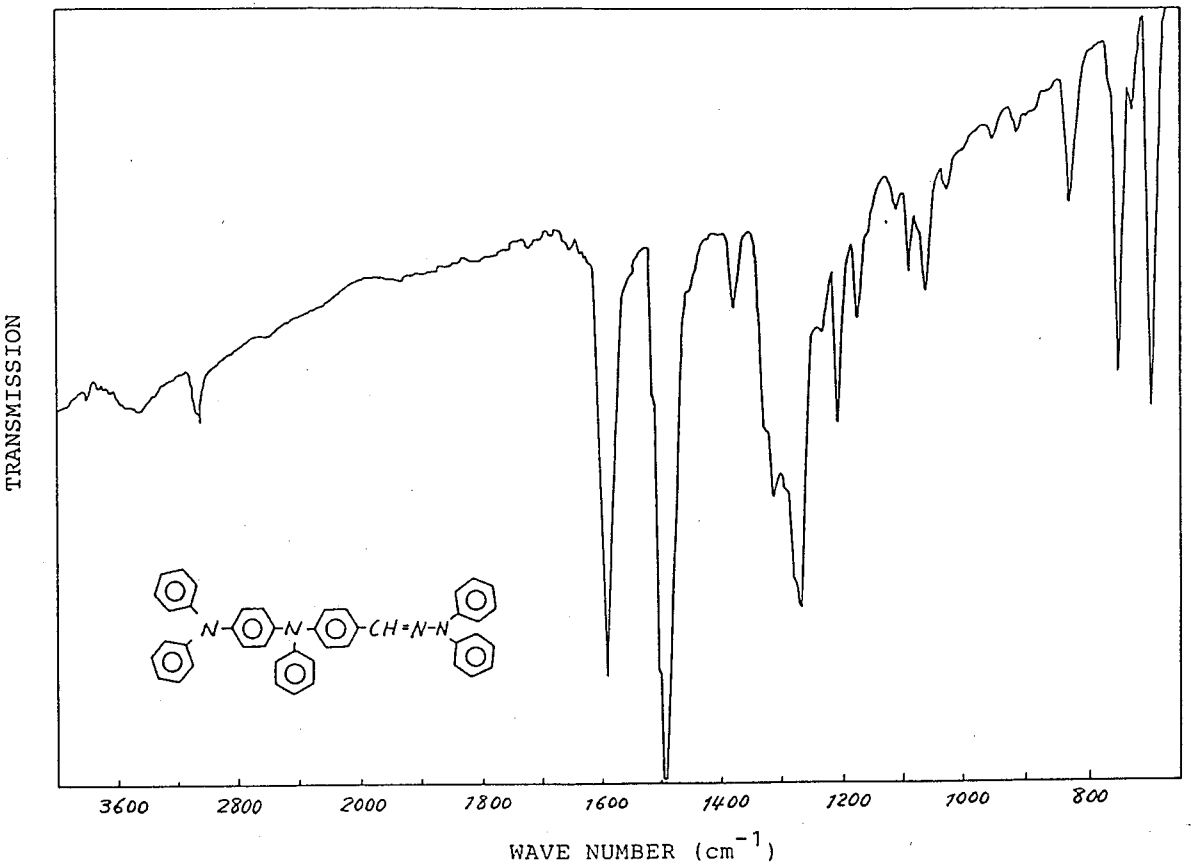
FIGS. 1 to 4 and 6 to 17 are each an infrared absorption spectrogram or a cyclic voltamogram of an arylaldehydehydrazone derivative employed as a charge transporting substance in the light-sensitive material of this invention.

The electrophotographic light-sensitive material of this invention contains as a charge transporting substance an arylaldehydehydrazone derivative of the general formula shown above, in which $R^1$, $R^2$ and $R^3$ are each an alkyl or aryl group.

The alkyl group may, for example, be a methyl, ethyl, propyl, butyl, pentyl, hexyl, octyl, nonyl or dodecyl group. It may be in the form of a straight or branched chain. The aryl group may, for example, be an unsubstituted or substituted phenyl, naphthyl, anthryl, pyrenyl, acenaphthenyl or fluorenyl group. If it is a substituted one, the substituent may, for example, be an alkyl group such as methyl, ethyl, propyl, butyl, pentyl, hexyl, octyl, nonyl or dodecyl, an alkoxy group such as methoxy, ethoxy, propoxy or butoxy, a halogen such as chlorine, bromine or fluorine, an aryloxy group such as phenoxy or tolyloxy, or a dialkylamino group such as dimethylamino, diethylamino or dipropylamino.

According to a preferred aspect of this invention, however, $R^1$, $R^2$ and $R^3$ are each a methyl, ethyl, propyl, butyl, phenyl, tolyl or chlorophenyl group.

The following compounds can, therefore, be given as specific preferred examples of the charge transporting substance according to this invention:

(1) p-[(p-diphenylaminophenyl)phenyl]aminobenzaldehydediphenylhydrazone

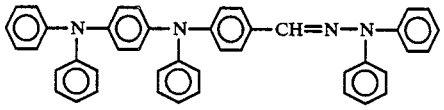

(2) p-[(p-(phenyl-p-tolylamino)phenyl)-p-tolyl]aminobenzaldehydediphenylhydrazone

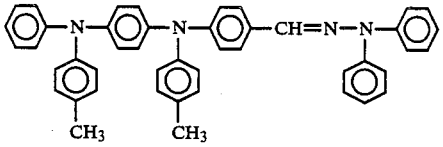

(3) p-[(p-(phenyl-m-tolylamino)phenyl)-m-tolyl]aminobenzaldehydediphenylhydrazone

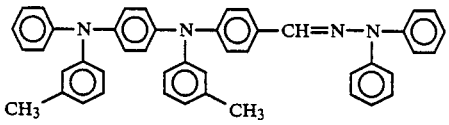

(4) p-[(p-(phenyl-p-tolylamino)phenyl)-p-tolyl]aminobenzaldehydemethylphenylhydrazone

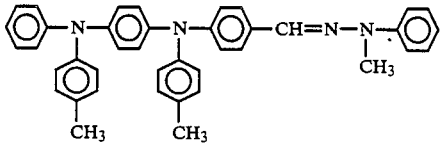

(5) p-[(p-diphenylaminophenyl)phenyl]aminobenzaldehydemethylphenylhydrazone

-continued

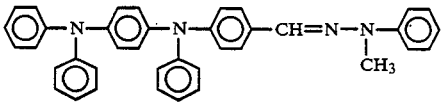

(6) p-[(p-(phenyl-m-tolylamino)phenyl)-m-tolyl]aminobenzaldehydemethylphenylhydrazone

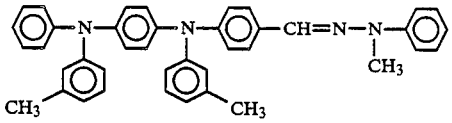

(7) p-[(p-phenylethylaminophenyl)ethyl]aminobenzaldehydediphenylhydrazone

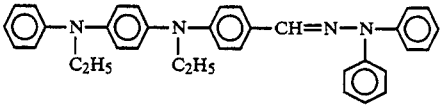

(8) p-[(p-(phenyl-p-chlorophenyl)phenyl)-p-chlorophenyl]-aminobenzaldehydediphenylhydrazone

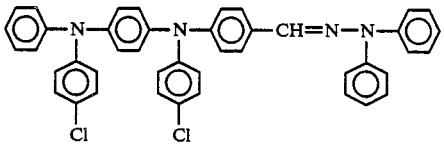

(9) p-[(p-(phenyl-p-chlorophenyl)phenyl)-p-chlorophenyl]-aminobenzaldehydemethylphenylhydrazone

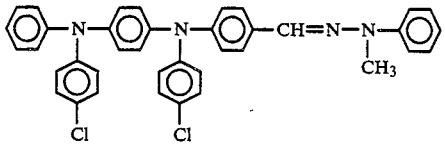

(10) p-[(p-(methylphenylamino)phenyl)methyl]aminobenzaldehydediphenylhydrazone

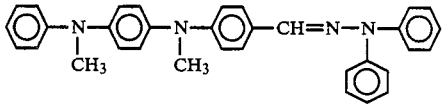

(11) p-[(p-(methylphenylamino)phenyl)methyl]aminobenzaldehydemethylphenylhydrazone

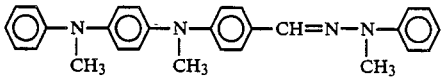

Any of these arylaldehydehydrazone derivatives can be manufactured by reacting the corresponding arylaldehyde with hydrazine appropriately in accordance with any customary process that is employed for producing aldehydehydrazone.

The electrophotographic light-sensitive material of this invention can be manufactured if a solution or dispersion of a charge producing substance in an organic solvent containing a resin as a bonding agent, which may further contain a plasticizer, etc. as required, is applied onto an electrically conductive support and dried to form a charge producing layer, and if a solution of an arylaldehydehydrazone derivative in an organic solvent containing a resin as a bonding agent, which may further contain a plasticizer, etc. as required, is applied onto the charge producing layer and dried to form a charge transporting layer. The order in which the two layers are formed can, however, be reversed, so that the charge transporting layer may be formed on the support.

The charge transporting layer preferably contains 10 to 60% by weight of the arylaldehydehydrazone derivative and has a thickness of 5 to 100 microns.

Any known substance can be used to form the charge producing layer. Examples of the substances which can be employed include a bisazo, a triazo, a metallophthalocyanine, a squalilium, a perillene, and a polycyclic quinoline pigment. The charge producing layer may usually contain 5 to 50% by weight of the resin as a bonding agent, though its content had better be lowered as far as possible within that range. Its thickness is usually from 0.05 to 20 microns, and preferably from 0.1 to 10 microns. The charge producing layer can also consist solely of a charge producing substance.

The resin used as a bonding agent is of the type which is soluble in an organic solvent and is highly compatible with a charge producing or transporting substance, so that a stable solution or dispersion thereof can be prepared easily. Moreover, it is preferable to use a resin which is inexpensive and can form a film of high mechanical strength, transparency and electrical insulating property. Preferred examples of the resin are polycarbonate, polystyrene, polyester and polyvinyl chloride resins. As regards the organic solvent, it is possible to use any solvent with any limitation in particular. Preferred examples of the organic solvent are, however, chloroform, 1,2-dichloroethane, 1,1,2,2-tetrachloroethane and tetrahydrofuran.

The invention will now be described more specifically with reference to a plurality of examples thereof which are not intended for limiting the scope of this invention. Prior to the description of these examples, however, there will be described a plurality of Reference Examples which are directed to the preparation of the arylaldehydehydrazone derivatives, and which are not intended for limiting the scope of this invention, either.

REFERENCE EXAMPLE 1

Synthesis of p-[(p-diphenylaminophenyl)phenyl]aminobeznaldehydediphenylhydrazone—Compound (1)

70 g (0.159 mol) of p-[(p-diphenylaminophenyl)-phenyl]aminobenzaldehyde, 61.3 g (0.238 mol) of diphenylhydrazine hydrochloride, 14.3 g (0.357 mol) of sodium hydroxide and five liters of ethanol were reacted at a reflux temperature for two hours in a flask containing a nitrogen atmosphere, whereby a sediment having a light yellow color was precipitated. The sediment was separated by filtration and washed with a small amount of methanol. It was dissolved in hot toluene and the inorganic salt was removed from its solution by filtration. The filtrate was recrystallized twice from toluene, whereby the captioned compound was obtained as fine crystals having a light yellow color. The compound pound weighed 29 g and showed, therefore, a yield of 30.1%.

Melting point: 230.0° C. to 231.5° C.

Mass analysis: Molecular ion peak 606.

Elemental analysis:

| | C | H | N |
|---|---|---|---|
| Calculated value | 85.12 | 5.65 | 9.23 |

-continued

| | C | H | N |
|---|---|---|---|
| Measured value | 85.18 | 5.72 | 9.00 |

Figure 2:
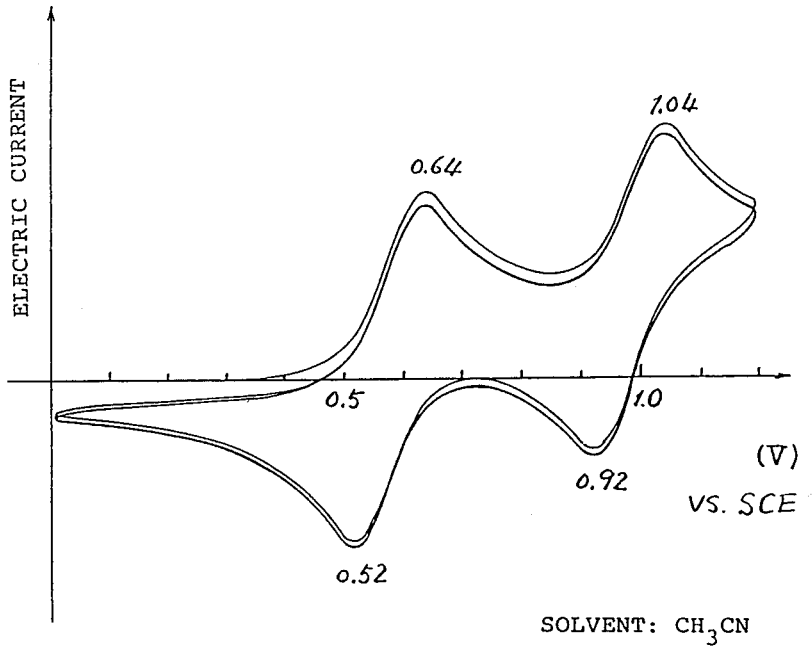

The infrared absorption spectrum of the compound is shown in FIG. 1. The results of its cyclic voltammetric analysis are shown in FIG. 2 to show one of its electrochemical properties. It shows the complete reversibility of the compound in an oxidation-reduction reaction.

REFERENCE EXAMPLE 2

Synthesis of p-[(p-(phenyl-p-tolylamino)phenyl)-p-tolyl]aminobenzaldehydediphenylhydrazone—Compound (2)

80 g (0.171 mol) of p-[(p-(phenyl-p-tolylamino)-phenyl)-p-tolyl]aminobenzaldehyde, 132.8 g (0.514 mol) of diphenylhydrazine hydrochloride, 30.8 g (0.772 mol) of sodium hydroxide and six liters of ethanol were reacted at a reflux temperature for six hours in a flask having a nitrogen atmosphere, whereby a sediment having a light yellow color was precipitated. The sediment was separated by filtration and washed with a small amount of methanol. It was dissolved in benzene and the undissolved inorganic matter was removed from its solution. The solution was subjected twice to recrystallization from a mixed solvent consisting of benzene and ethanol in a ratio of 2:3, whereby the captioned compound was obtained as fine crystals having a light yellow color. The compound weighed 50 g and showed, therefore, a yield of 46.1%.

Figure 3:
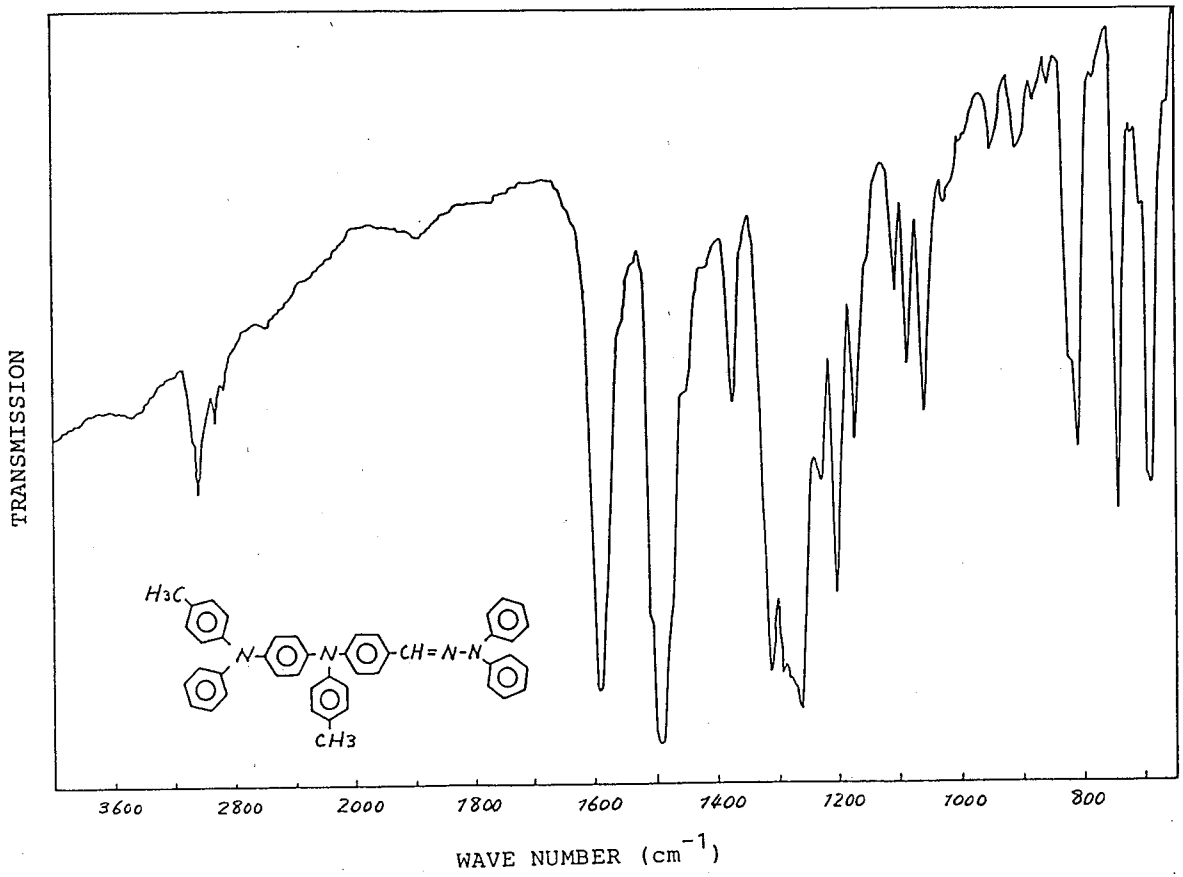
Figure 4:
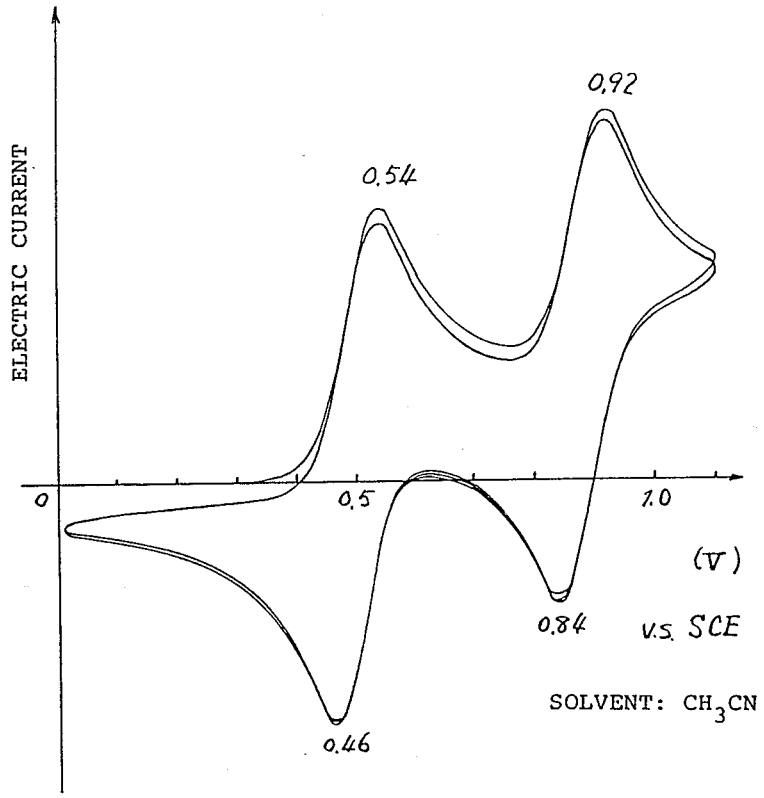

The infrared absorption spectrum of the compound is shown in FIG. 3, and the results of its cyclic voltammetric analysis in FIG. 4. It showed complete reversibility in a oxidation-reduction reaction.

Figure 5:
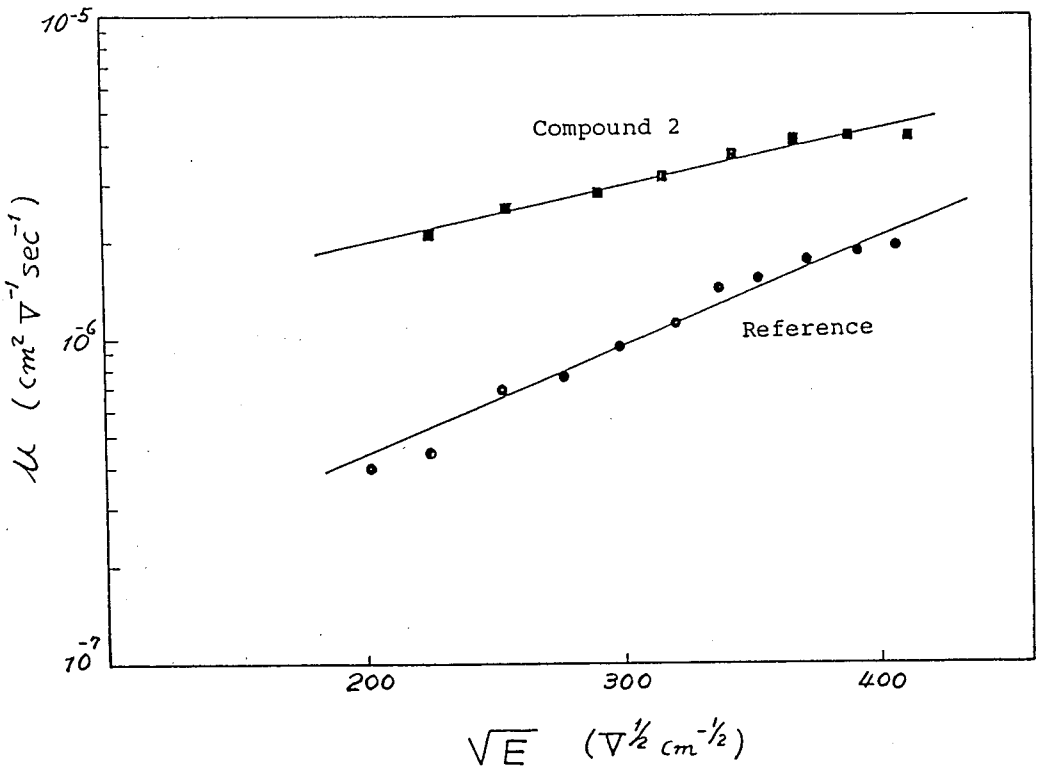
FIG. 5 is a graph showing the charge transfer rates of two compositions which were obtained by dissolving in polycarbonate equal proportions by weight of compound (2) according to this invention, which will hereinafter be described, and p-diethylaminobenzaldehydediphenylhydrazone employed for the sake of comparison, respectively.

FIG. 5 shows the charge transfer rate of the composition which was obtained by dissolving the compound in polycarbonate in equal proportions by weight. FIG. 5 also shows the charge transfer rate of the polycarbonate composition which was likewise prepared by employing p-diethylaminobenzaldehydediphenylhydrazone as a charge transporting substance for the sake of comparison. As is obvious therefrom, the compound (2) showed a higher charge transfer rate than that of the comparative composition.

The compound (2) further showed the following data:

Melting point: 193.5° C. to 195.0° C.;

Mass analysis: Molecular ion peak 634.

Elemental analysis:

| | C | H | N |
|---|---|---|---|
| Calculated value | 85.14 | 6.03 | 8.83 |
| Measured value | 85.16 | 6.08 | 8.76 |

REFERENCE EXAMPLE 3

Synthesis of p-[(p-phenyl-p-tolylamino)phenyl)-p-tolyl]aminobenzaldehydemethylphenylhydrazone Compound (4)

50 g (0.107 mol) of p-[(p-phenyl-p-tolylamino)and phenyl)-p-tolyl]aminobenzaldehyde and 26.1 g (0.213 mol) of methylphenylhydrazine were reacted at a reflux temperature for two hours in two liters of tetrahydrofuran in a flask having a nitrogen atmosphere. After the reaction had been completed, the solvent was removed by distillation, whereby oily matter was obtained. The oily matter was refined and separated by silica gel chromatography employing benzene. Then, it was recrystallized twice from a mixed solvent consisting of benzene and ethanol in a ratio of 1:1, whereby the captioned compound was obtained as fine crystals having a light yellow color. The compound weighed 38.0 g and showed, therefore, a yield of 62%.

Other data of the compound were as follows:
Melting point: 184.5° C. to 185.5° C.;
Mass analysis: Molecular ion peak 572.
Elemental analysis:

| | C | H | N |
|---|---|---|---|
| Calculated value | 83.88 | 6.34 | 9.78 |
| Measured value | 83.96 | 6.34 | 9.51 |

Figure 6:
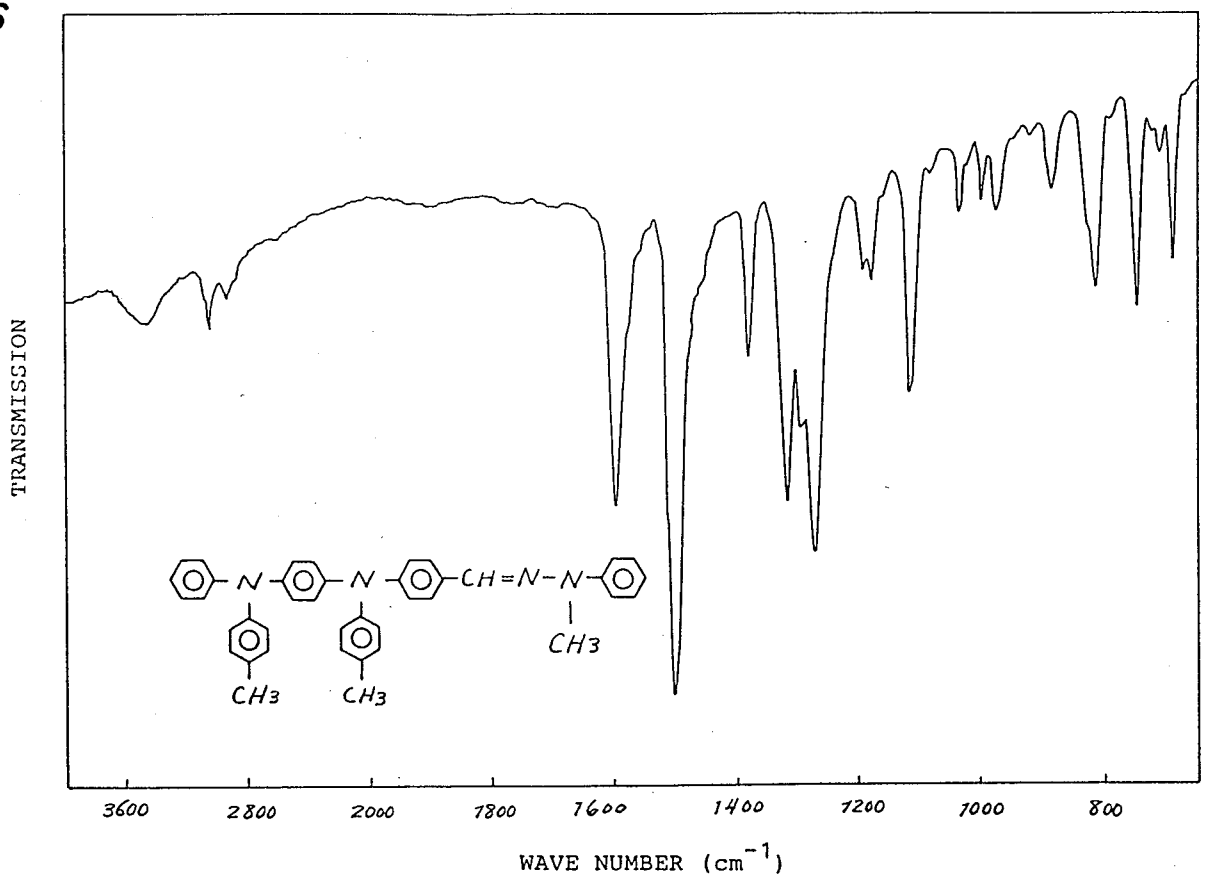
Figure 7:
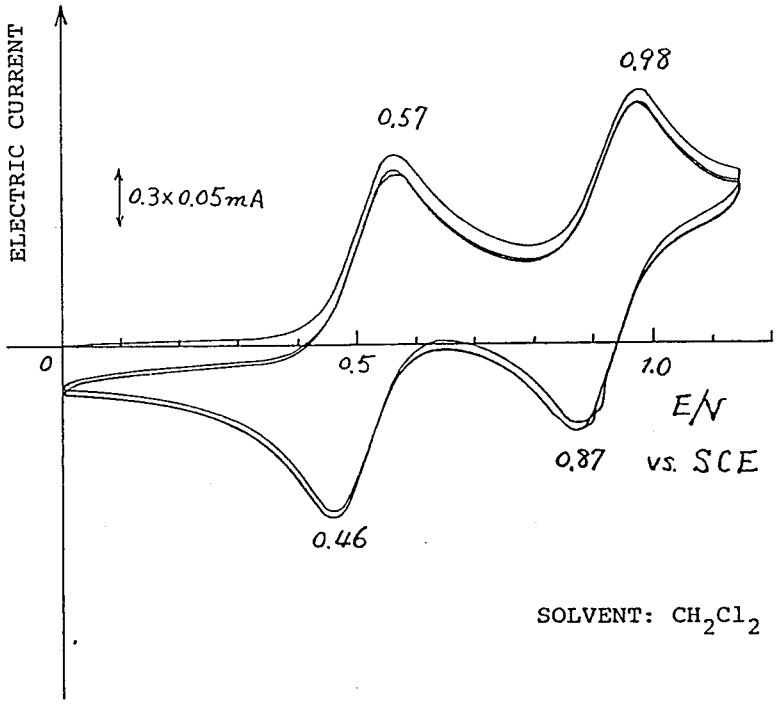

The infrared absorption spectrum of the compound is shown in FIG. 6, and the results of its cyclic voltammetric analysis in FIG. 7. It showed complete reversibility in a oxidation-reduction reaction. A compatibilized composition was prepared by dissolving the compound in polycarbonate in equal proportions by weight and its charge transfer rate is shown in TABLE 1 below.

REFERENCE EXAMPLE 4

Synthesis of p-[(p-diphenylaminophenyl)phenyl]aminobenzaldehydemethylphenylhydrazone—Compond (5')

50 g (0.114 mol) of p-[(p-diphenylaminophenyl)-phenyl]aminobenzaldehyde and 27.7 g (0.227 mol) of methylphenylhydrazine were reacted at a reflux temperature for two hours in two liters of tetrahydrofuran in a flask having a nitrogen atmosphere. After the reaction had been completed, the solvent was removed by distillation, whereby oily matter was obtained. The oily matter was refined and separated by silica gel chromatography employing benzene. Then, it was recrystallized twice from a mixed solvent consisting of benzene and ethanol in a ratio of 1:1, whereby the compound was obtained as fine crystals having a light yellow color. The compound weighed 38.0 g and showed, therefore, a yield of 62%.

Other data of the compound were as follows:
Melting point: 179° C. to 180° C.;
Mass analysis:Molecular ion peak 544.
Elemental analysis:

| | C | H | N |
|---|---|---|---|
| Calculated value | 83.79 | 5.92 | 10.29 |
| Measured value | 83.87 | 5.97 | 10.09 |

Figure 8:
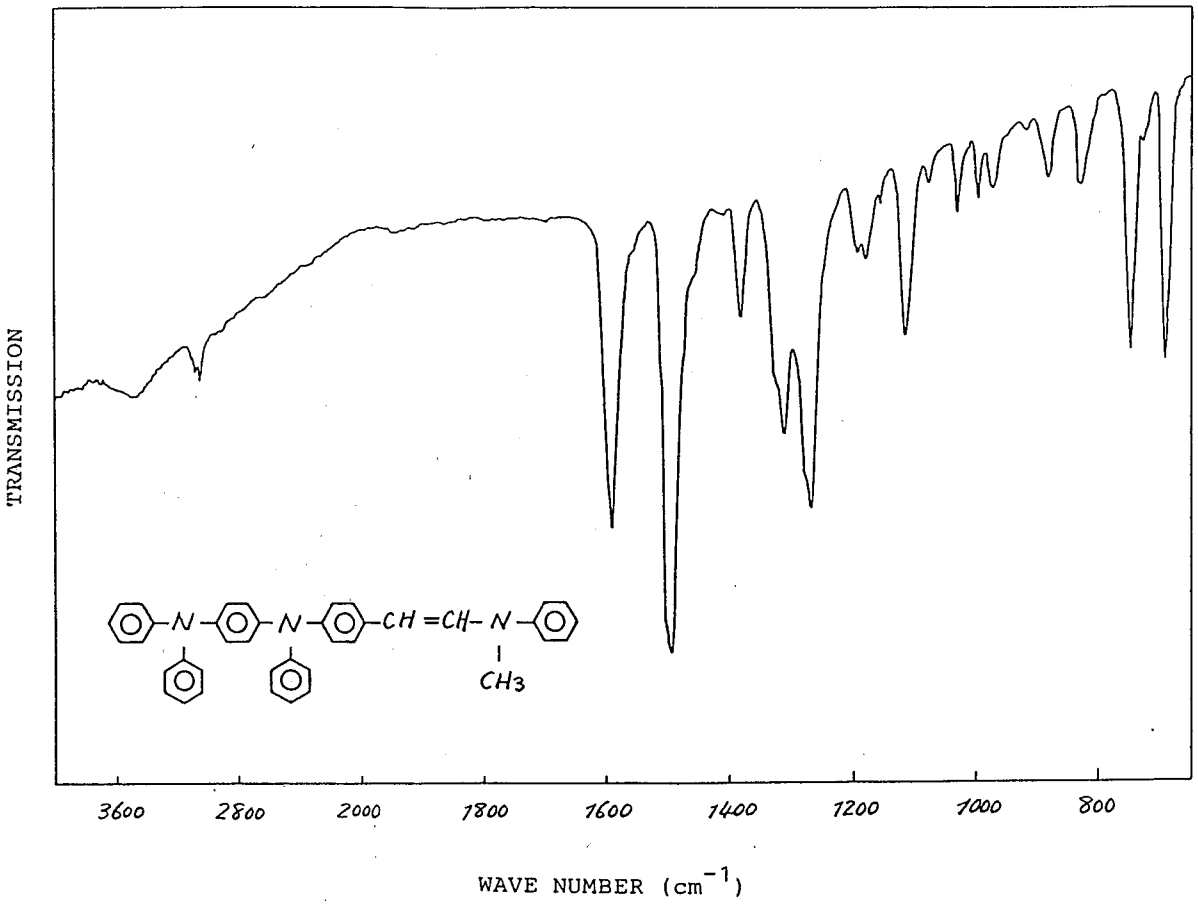
Figure 9:
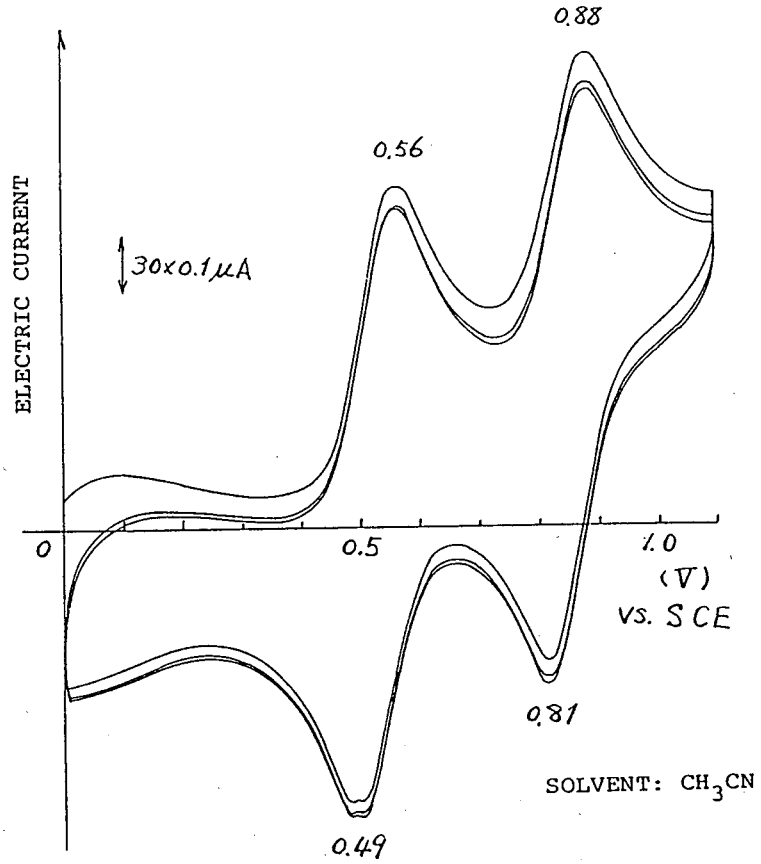

The infrared absorption spectrum of the compound is shown in FIG. 8, and the results of its cyclic voltammetric analysis in FIG. 9. It showed complete reversibility in an oxidation-reduction reaction. A compatibilized composition was prepared by dissolving the compound in polycarbonate in equal proportions by weight and its charge transfer rate is shown in TABLE 1.

REFERENCE EXAMPLE 5

Synthesis of p-[(p-phenyl-p-chlorophenyl)phenyl)-p-chlorophenyl-]aminobenzaldehydediphenylhydrazone Compound (8)

100 g (0.196 mol) of p-[(p-phenyl-p-chlorophenyl)-phenyl)-p-chlorophenyl]aminobenzaldehyde, 151 g (0.589 mol) of diphenylhydrazone hydrochloride and 66 g (0.784 mol) of sodium hydrogen carbonate were reacted at a reflux temperature for three hours in three liters of tetrahydrofuran in a flask having a nitrogen atmosphere. After the reaction had been completed, the undissolved inorganic matter was removed by filtration, and the solvent by distillation, whereby oily matter was obtained. The oily matter was refined and separated by silica gel chromatography employing a mixed solvent consisting of benzene and hexane in a ratio of 1:1. Then, it was recrystallized twice from a mixed solvent consisting of benzene and ethanol in a ratio of 3:2, whereby the captioned compound was obtained as fine crystals having a light yellow color. The compound weighed 95 g and showed, therefore, a yield of 72%.

Other data of the compound were as follows:
Melting point: 199.5° C. to 201.0° C.;
Mass analysis: Molecular ion peak 675.
Elemental analysis:

| | C | H | N |
|---|---|---|---|
| Calculated value | 76.44 | 4.77 | 8.29 |
| Measured value | 76.38 | 4.84 | 8.08 |

Figure 10:
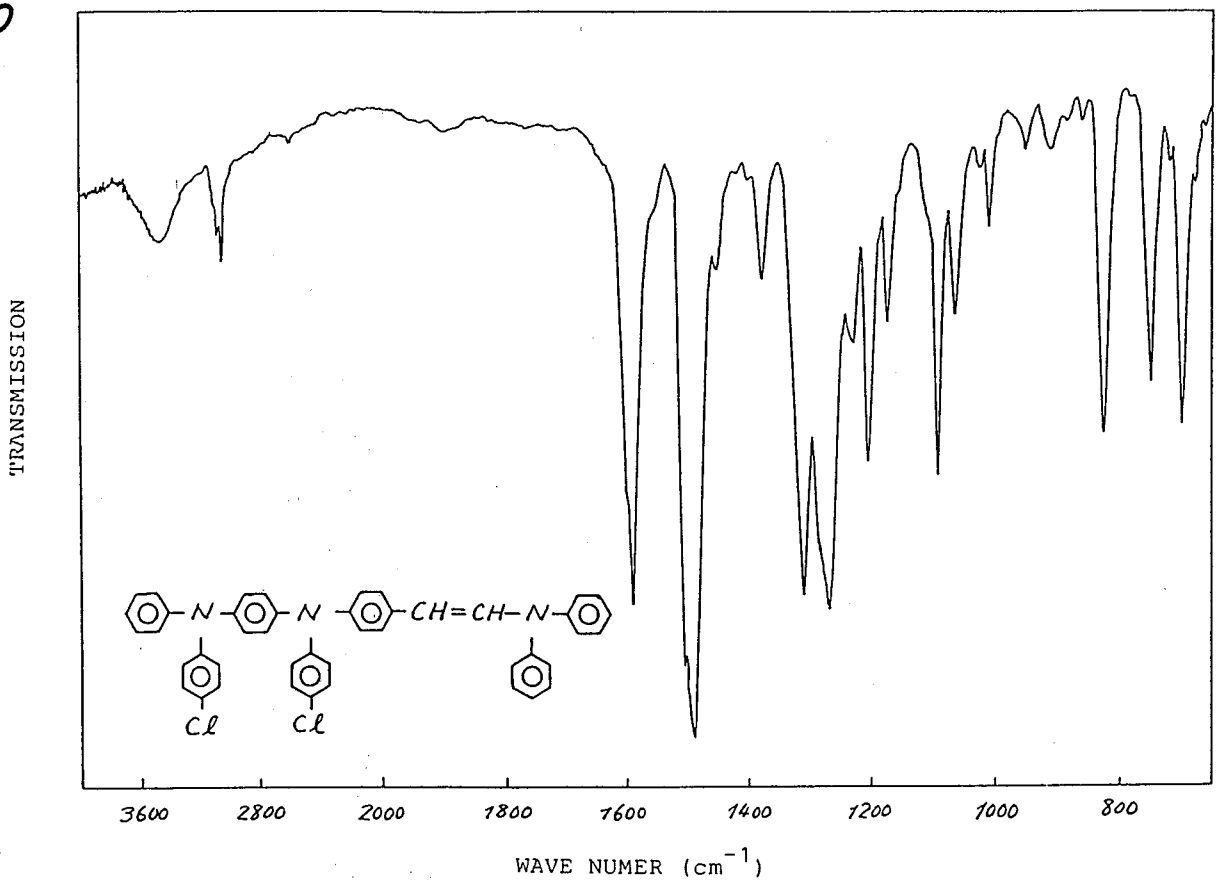
Figure 11:
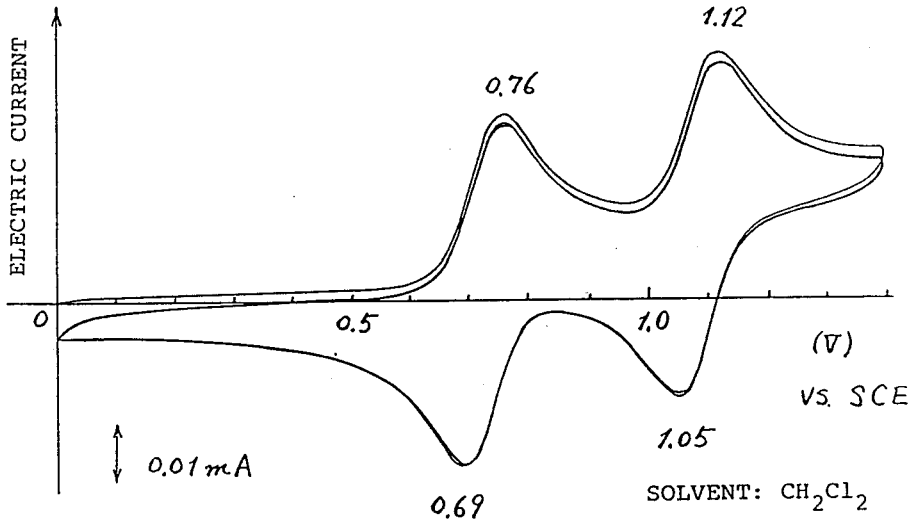

The infrared absorption spectrum of the compound is shown in FIG. 10, and the results of its cyclic voltammetric analysis in FIG. 11. It showed complete reversibility in an oxidation-reduction reaction. A compatibilized composition was prepared by dissolving the compound in polycarbonate in equal proportions by weight and its charge transfer rate is shown in TABLE 1.

REFERENCE EXAMPLE 6

Synthesis of p-[(p-phenyl-p-chlorophenyl)phenyl)-p-chlorophenyl-]aminobenzaldehydemethylphenylhydrazone—Compound (9)

22 g (0.043 mol) of p-[(p-phenyl-p-chlorophenyl)-phenyl)-p-chlorophenyl]aminobenzaldehyde and 10.6 g (0.086 mol) of methylphenylhydrazine were reacted at a reflux temperature for two hours in two liters of tetrahydrofuran in a flask having a nitrogen atmosphere. After the reaction had been completed, the solvent was removed by distillation, whereby oily matter was obtained. The oily matter was refined and separated by silica gel chromatography employing benzene. Then, it was recrystallized twice from a mixed solvent consisting of benzene and ethanol in a ratio of 1:1, whereby the captioned compound was obtained as fine crystals having a light yellow color. The compound weighed 17.0 g and showed, therefore, a yield of 64%.

Other data of the compound were as follows:
Melting point: 189° C. to 192° C.;
Mass analysis Molecular ion peak 612.
Elemental analysis:

| | C | H | N |
|---|---|---|---|
| Calculated value | 74.39 | 4.93 | 9.13 |
| Measured value | 74.59 | 4.97 | 9.01 |

Figure 12:
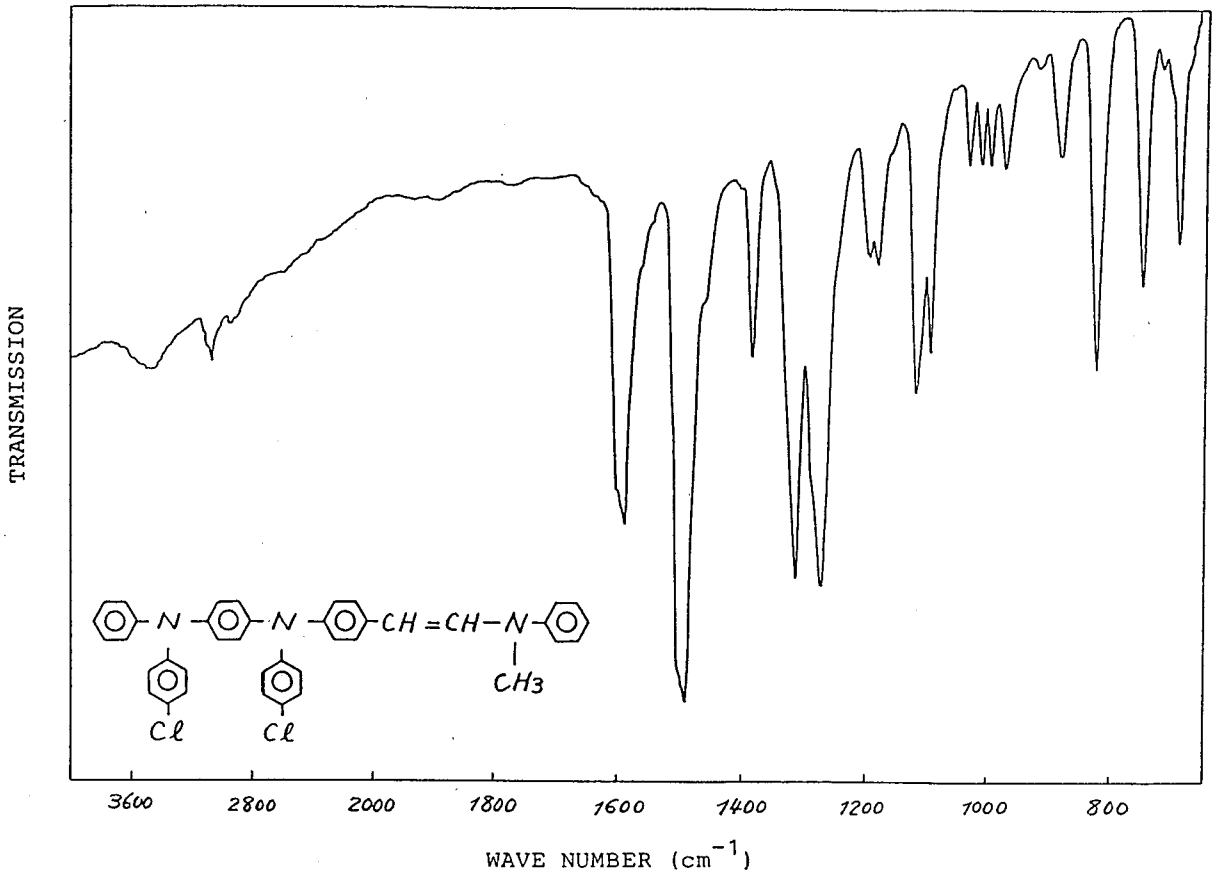
Figure 13:
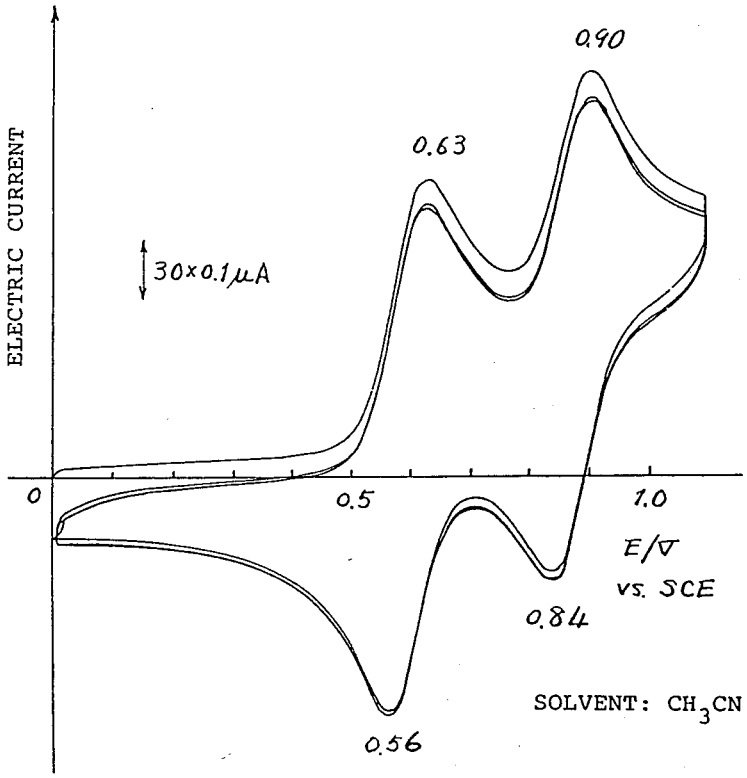

The infrared absorption spectrum of the compound is shown in FIG. 12, and the results of its cyclic voltammetric analysis in FIG. 13. It showed complete reversibility in an oxidation-reduction reaction. A compatibilized composition was prepared by dissolving the compound in polycarbonate in equal proportions by weight and its charge transfer rate is shown in TABLE 1.

REFERENCE EXAMPLE 7

Synthesis of p-[(p-methylphenylamino)phenyl)methyl]aminobenzaldehydediphenylhydrazone—Compound (10)

10 g (0.032 mol) of p-[(p-methylphenylamino)-phenyl)methyl]aminobenzaldehyde, 12.2 g (0.047 mol) of diphenylhydrazine hydrochloride and 4.2 g (0.05 mol) of sodium hydrogen carbonate were reacted at a reflux temperature for four hours in 200 ml of tetrahydrofuran in a flask having a nitrogen atmosphere. After the reaction had been completed, the undissolved inorganic matter was removed by filtration, and the solvent by distillation, whereby oily matter was obtained. The oily matter was refined and separated by silica gel chromatography employing a mixed solvent consisting of benzene and hexane in a ratio of 1:1. Then, it was recrystallized from a mixed solvent consisting of benzene and ethanol in a ratio of 1:5, whereby the captioned compound was obtained as leaf-shaped crystals having a light yellow color. The compound weighed 7.3 g and showed, therefore, a yield of 48%.

Other data of the compound were as follows:

Melting point: 115° C. to 117° C.;

Mass analysis: Molecular ion peak 482.

Elemental analysis;

| | C | H | N |
|---|---|---|---|
| Calculated value | 82.13 | 6.27 | 11.61 |
| Measured value | 82.04 | 6.21 | 11.58 |

Figure 14:
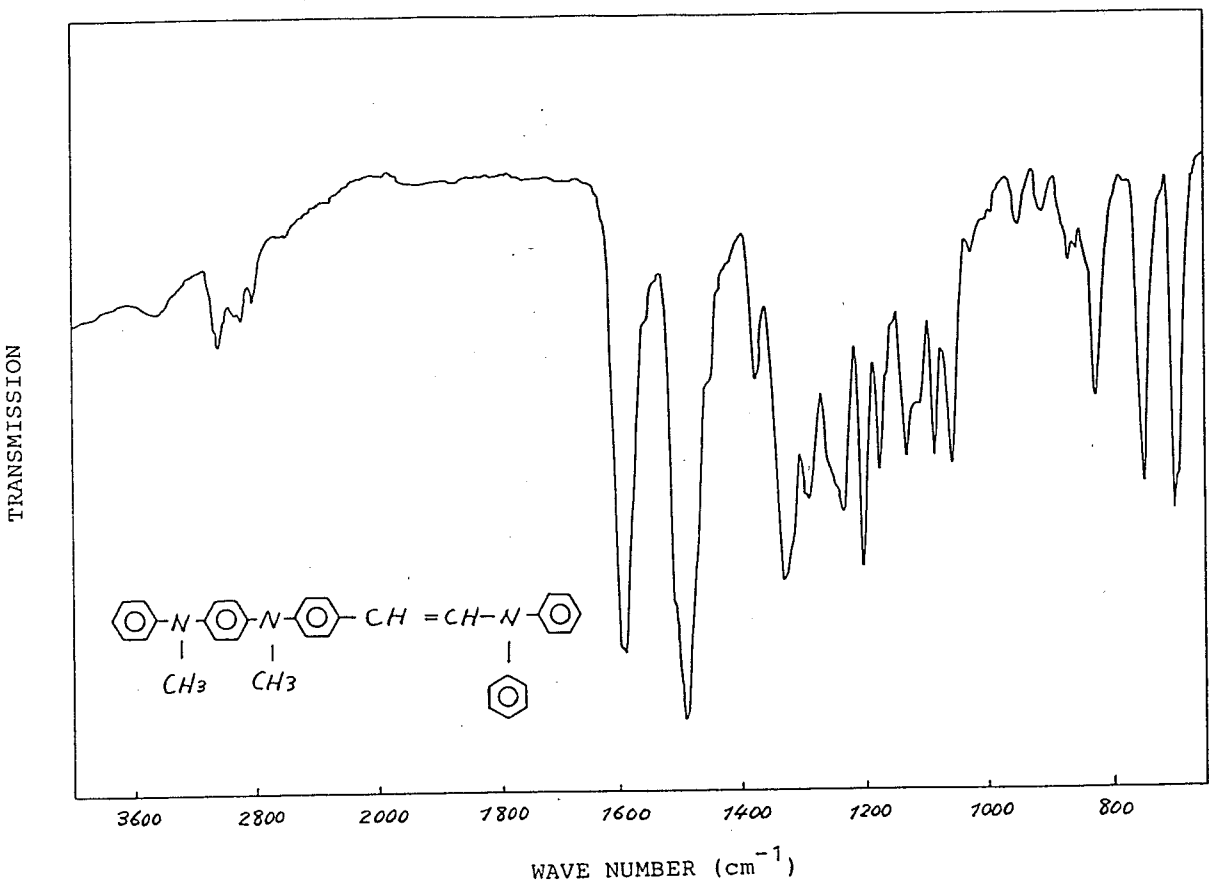
Figure 15:
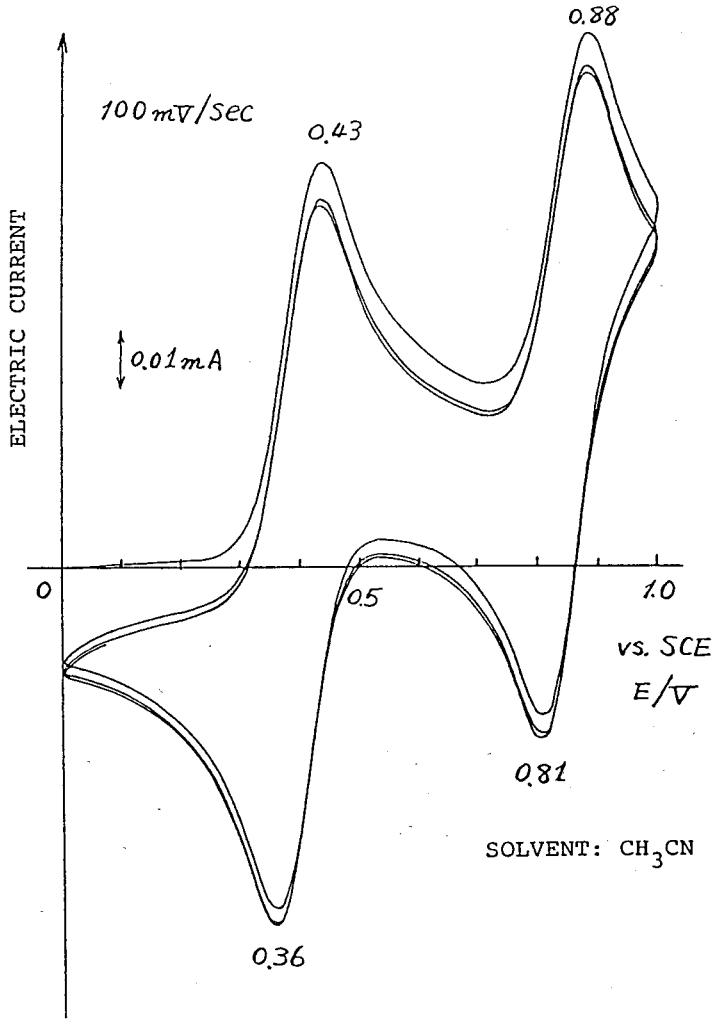

The infrared absorption spectrum of the compound is shown in FIG. 14, and the results of its cyclic voltammetric analysis in FIG. 15. It showed complete reversibility in an oxidation-reduction reaction. A compatibilized composition was prepared by dissolving the compound in polycarbonate in equal proportions by weight and its charge transfer rate is shown in TABLE 1.

TABLE 1

| Charge transporting substance | Charge transfer rate $\mu$ ($cm^2/V \cdot sec$) |
|---|---|
| Compound (1) | $2.01 \times 10^{-6}$ |
| (2) | $2.11 \times 10^{-6}$ |
| (4) | $2.76 \times 10^{-6}$ |
| (5) | $2.76 \times 10^{-6}$ |
| (8) | $2.73 \times 10^{-6}$ |
| (9) | $1.76 \times 10^{-6}$ |
| (10) | $1.40 \times 10^{-6}$ |
| (11) | $1.26 \times 10^{-6}$ |
| Comparative compound | $1.10 \times 10^{-6}$ |

Note:
[a]Measured at an electric field of $10^5$ V/cm and a temperature of 25° C.;
[b]Comparative compound: N,N—diethylamino-benzaldehydediphenylhydrazone.

REFERENCE EXAMPLE 8

Synthesis of p-[(p-methylphenylamino)phenyl)methyl]aminobenzaldehydemethylphenylhydrazone—Compound (11 )

10 g (0.032 mol) of p-[(p-methylphenylamino)-phenyl)methyl]aminobenzaldehyde and 7.79 g (0.064 mol) of methylphenylhydrazine were reacted at a reflux temperature for five hours in 200 ml of tetrahydrofuran in a flask having a nitrogen atmosphere. After the reaction had been completed, the solvent was removed by distillation, whereby oily matter was obtained. The oily matter was refined and separated by silica gel chromatography employing a mixed solvent consisting of benzene and hexane in a ratio of 1:1. Then, it was recrystallized from a mixed solvent consisting of benzene and ethanol in a ratio of 1:1, whereby the captioned compound was obtained as fine crystals having a light yellow color. The compound weighed 9.2 g and showed, therefore, a yield of 69 %.

Other data of the compound were as follows:

Melting point: 152° C. to 154° C.;

Mass analysis: Molecular ion peak 420.

Elemental analysis:

| | C | H | N |
|---|---|---|---|
| Calculated value | 79.97 | 6.71 | 13.32 |
| Measured value | 80.22 | 6.64 | 13.23 |

Figure 16:
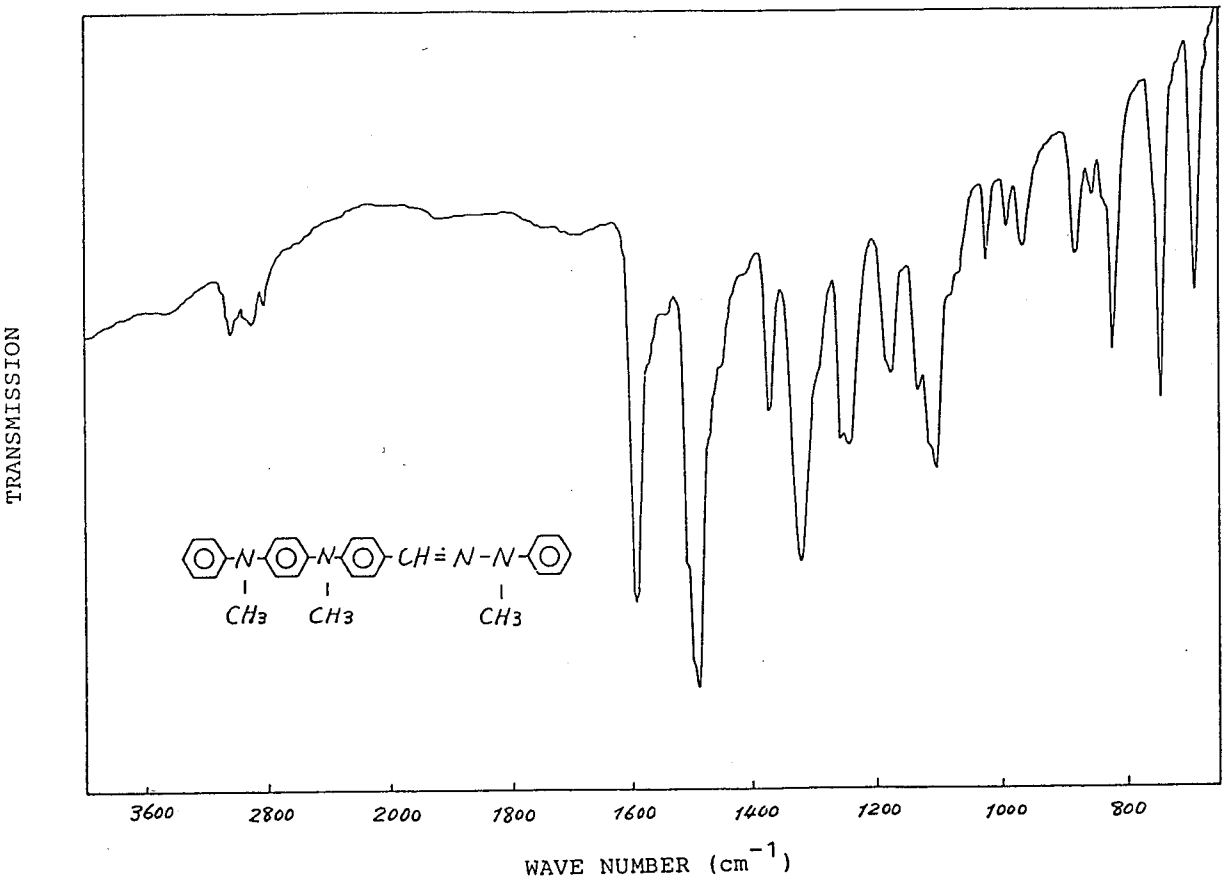
Figure 17:
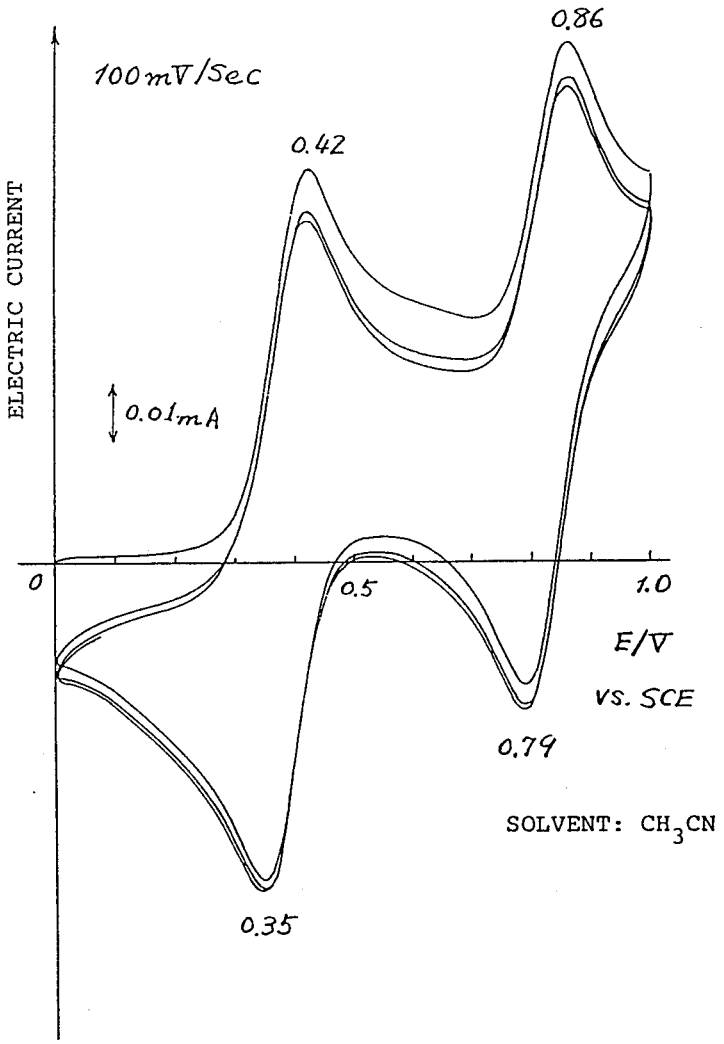
Figure 18:
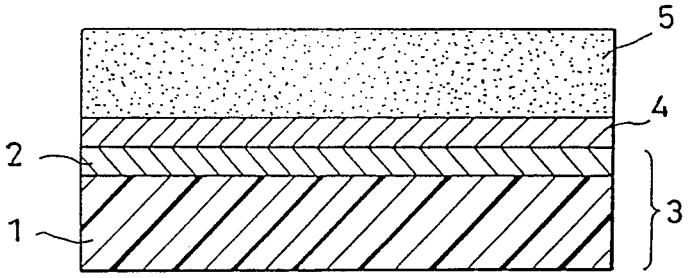
FIG. 18 is a cross sectional view of a laminated type electrophotographic light-sensitive material.

The infrared absorption spectrum of the compound is shown in FIG. 16, and the results of its cyclic voltammetric analysis in FIG. 17. Its oxidation-reduction reactions were completely reversible. A compatibilized composition was prepared by dissolving the compound in polycarbonate in equal proportions by weight and its charge transfer rate was as shown in TABLE 1 above.

The following is a description of the examples directed to the preparation of the light-sensitive materials embodying this invention:

EXAMPLE 1

0.5 part by weight of polycarbonate (IUPILON E2000 of Mitsubishi Gas Chemical Industrial Co., Ltd.) and 0.5 part by weight of chlorodyan blue as a charge producing substance were added to 99 parts by weight of chloroform. They were crushed in a ball mill for 20 hours to prepare a dispersion. The dispersion was applied by a doctor blade having a clearance of 50 microns onto a polyethylene terephthalate film on which aluminum had been deposited, and was allowed to dry at room temperature. Then, it was dried by heating at 80° C. for thirty minutes to form a charge producing layer having a thickness of 0.7 micron.

Six parts by weight of p-[(p-diphenylaminophenyl)-phenyl]aminobenzaldehydediphenylhydrazone [Compound (1)] and six parts by weight of polycarbonate (product of Mitsubishi Gas Chemical as hereinabove stated) were dissolved in 88 parts by weight of chloroform to prepare a solution. The solution was applied onto the charge producing layer by a doctor blade having a clearance of 100 microns. After the coating had been allowed to dry at room temperature, it was dried by heating at 80° C. for an hour to form a charge transporting layer having a thickness of 15 microns, whereby a laminated light-sensitive material was obtained.

EXAMPLE 2

A laminated light-sensitive material was made by following the procedures of EXAMPLE 1, except that p-[(p-phenyl-p-tolylamino)phenyl)-p-tolyl]aminobenzaldehydediphenylhydrazone [Compound (2)] was used as the charge transporting substance.

COMPARATIVE EXAMPLE 1

A laminated light-sensitive material was made by following the procedures of EXAMPLE 1, except that N,N-diethylaminobenzaldehydediphenylhydrazone was used as the charge transporting substance.

EXAMPLE 3

0.17 part by weight of polycarbonate (the same product as had been used in EXAMPLE 1) and 0.33 part by weight of titanyl phthalocyanine as a charge producing substance were added to 99.5 parts by weight of chloroform. They were crushed in a ball mill for 20 hours to prepare a dispersion. The dispersion was applied by a doctor blade having a clearance of 50 microns onto a polyethylene terephthalate film on which aluminum had been deposited. It was allowed to dry at room temperature to form a charge producing layer having a thickness of 0.3 micron.

A solution was prepared by dissolving six parts by weight of p-[(p-diphenylaminophenyl)phenyl-]aminobenzaldehydediphenylhydrazone [Compound (1)] and six parts by weight of polycarbonate (the same product as had been used in EXAMPLE 1) in 88 parts by weight of chloroform. It was applied onto the charge producing layer by a doctor blade having a clearance of 100 microns. After the coating had been allowed to dry at room temperature, it was dried by heating at 80° C. for an hour to form a charge transporting layer having a thickness of 15 microns, whereby a laminated light-sensitive material was obtained.

EXAMPLE 4

A laminated light-sensitive material was made by following the procedures of EXAMPLE 3, except that p-[(p-(phenyl-p-tolylamino)phenyl)-p-tolyl]aminobenzaldehydediphenylhydrazone [Compound (2)] was used as the charge transporting substance.

COMPARATIVE EXAMPLE 2

A laminated light-sensitive material was made by repeating EXAMPLE 3, except that N,N-diethylaminobenzaldehydediphenylhydrazone was used as the charge transporting substance.

EXAMPLE 5

A laminated light-sensitive material was made by repeating EXAMPLE 3, except that p-[(p-(diphenylaminophenyl)phenyl]aminobenzaldehydemethylphenylhydrazone Compound [Compound (5)] was used as the charge transporting substance.

EXAMPLE 6

A laminated light-sensitive material was made by repeating EXAMPLE 3, except that p-[(p-(phenyl-p-tolylamino)phenyl)-p-tolyl]aminobenzaldehydemethylphenylhydrazone [Compound (4)] was used as the charge transporting substance.

EXAMPLE 7

A laminated light-sensitive material was made by repeating EXAMPLE 3, except that p-[(p-(phenyl-p-chlorophenyl)phenyl)-p-chlorophenyl]aminobenzaldehydediphenylhydrazone [Compound (8)] was used as the charge transporting substance.

EXAMPLE 8

A laminated light-sensitive material was made by repeating EXAMPLE 3, except that p-[(p-(phenyl-p-chloro-phenyl)phenyl)-p-chlorophenyl]aminobenzaldehydemethylphenylhydrazone [Compound (9)] was used as the charge transporting substance.

EXAMPLE 9

0.41 part by weight of a copolymer of vinyl chloride and vinyl acetate having a weight ratio of 85:15 and 0.56 part by weight of X-type non-metal phthalocyanine as a charge producing substance were added to 74.28 parts by weight of tetrahydrofuran and they were crushed in a ball mill for two hours. Then, 24.76 parts by weight of tetrahydrofuran were added to the mixture to dilute it and prepare a dispersion. The dispersion was applied by a doctor blade having a clearance of 50 microns onto a polyethylene terephthalate film on which aluminum had been deposited. After the coating had been allowed to dry at room temperature, it was dried by heating at 80° C. for an hour to form a charge producing layer having a thickness of 0.3 micron.

Six parts by weight of p-[(p-diphenylaminophenyl)-phenyl]aminobenzaldehydemethylphenylhydrazone [Compound (5)] as a charge transporting substance and six parts by weight of polycarbonate (the same product as had been used in EXAMPLE 1) were dissolved in 88 parts by weight of chloroform. The resulting solution was applied onto the charge producing layer by a doctor blade having a clearance of 100 microns. After the coating had been allowed to dry at room temperature, it was dried by heating at 80° C. for an hour to form a charge transporting layer having a thickness of 15 microns, whereby a laminated light-sensitive material was obtained.

EXAMPLE 10

A laminated light-sensitive material was made by repeating EXAMPLE 9, except that p-[(p-(phenyl-p-tolylamino)phenyl)-p-tolyl]aminobenzaldehydemethylphenylhydrazone [Compound (4)] was used as the charge transporting substance.

EXAMPLE 11

A laminated light-sensitive material was made by repeating EXAMPLE 9, except that p-[(phenyl-p-chlorophenyl)phenyl)-p-chlorophenyl]aminobenzaldehyde diphenylhydrazone [Compound (8)] was used as the charge transporting substance.

EXAMPLE 12

A laminated light-sensitive material was made by repeating EXAMPLE 9, except that p-[(p-(phenyl-p-chlorophenyl)phenyl)-p-chlorophenyl]aminobenzaldehydemethylphenylhydrazone [Compound (9)] was used as the charge transporting substance.

COMPARATIVE EXAMPLE 3

A laminated light-sensitive material was made by repeating EXAMPLE 9, except that N,N-diethylaminobenzaldehydediphenylhydrazone was used as the charge transporting substance.

EXAMPLE 13

A laminated light-sensitive material was made by repeating EXAMPLE 9, except that p-[(p-(methylphenylamino)phenyl)methyl]aminobenzaldehydediphenylhydrazone [Compound (10)] was used as the charge transporting substance.

The light-sensitive materials which had been prepared as hereinabove described were each evaluated for electrostatic charging characteristics by means of an electrostatic copying paper testing device (Model SP428 of Kawaguchi Electric Machine Mfg. Co., Ltd.).

The surface of each material was negatively charged with a corona discharge of −6 kV. Some materials were each irradiated with white light having an illumination of 5 lux, and some with monochromatic light having a wavelength of 750 nm and a luminous intensity of 0.5, $\mu W/cm^2$. The length of time was measured until the point at which the surface potential of each material dropped to a half of its initial value, and the half-life exposure $E_{\frac{1}{2}}$ of each material to that point of time was determined as its light sensitivity. The results which were obtained when white light was employed are shown in TABLE 2, and the results which were obtained when monochromatic light was employed, in TABLE 3. As is obvious therefrom, the light-sensitive materials of this invention showed a high degree of sensitivity to both white and monochromatic light.

TABLE 2

| Electrophotographic light-sensitive material | Half-life exposure $E_{\frac{1}{2}}$ (lux · sec) |
|---|---|
| EXAMPLE 1 | 2.5 |
| EXAMPLE 2 | 2.0 |
| COMPARATIVE EXAMPLE 1 | 4.0 |
| EXAMPLE 3 | 0.6 |
| EXAMPLE 4 | 0.5 |
| COMPARATIVE EXAMPLE 2 | 1.1 |

TABLE 3

| Electrophotographic light-sensitive material | Half-life exposure $E_{\frac{1}{2}}$ ($\mu J/cm^2$) |
|---|---|
| EXAMPLE 3 | 0.28 |
| EXAMPLE 4 | 0.23 |
| EXAMPLE 5 | 0.31 |
| EXAMPLE 6 | 0.44 |
| EXAMPLE 7 | 0.23 |
| EXAMPLE 8 | 0.35 |
| COMPARATIVE EXAMPLE 2 | 0.63 |

TABLE 4 shows the initial potential and half-life exposure of each of the materials according to EXAMPLES 9 to 13 and COMPARATIVE EXAMPLE 3.

TABLE 4

| Electrophotographic light-sensitive material | Initial potential (V) | Half-life exposure $E_{\frac{1}{2}}$ ($\mu J/cm^2$) |
|---|---|---|
| EXAMPLE 9 | 880 | 0.76 |
| EXAMPLE 10 | 878 | 0.74 |
| EXAMPLE 11 | 873 | 0.64 |
| EXAMPLE 12 | 750 | 0.50 |
| EXAMPLE 13 | 1065 | 0.56 |
| COMPARATIVE EXAMPLE 3 | 908 | 1.19 |

The electrophotographic light-sensitive materials according to this invention, as well as the materials of the COMPARATIVE EXAMPLES, were tested for electrophotographic reproduction. All of the materials according to this invention could reproduce an image which was superior to what was obtained by any of the materials according to the COMPARATIVE EXAMPLES. The materials according to this invention were also excellent in printing resistance, as no change was found in the quality of image even after reproduction had been repeated several thousand times.

What is claimed is:

1. In an electrophotographic light-sensitive material having a layer of a charge transporting substance and a layer of a charge producing substance on an electrically conductive support, the improvement wherein said charge transporting substance is an arylaldehydehydrazone derivative of the general formula:

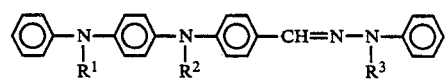

where $R^1$, $R^2$ and $R^3$ are each an alkyl or aryl group.

2. A material as set forth in claim 1, wherein said charge transporting substance is an arylaldehydehydrazone derivative of the general formula:

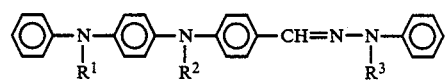

where $R^1$, $R^2$ and $R^3$ are each a methyl, ethyl, phenyl, alkyl-substituted phenyl or halogenated phenyl group.

* * * * *